US008371008B2

(12) United States Patent
Takeuchi et al.

(10) Patent No.: US 8,371,008 B2
(45) Date of Patent: Feb. 12, 2013

(54) APPARATUS FOR PUSHING HOLLOW CYLINDRICAL MEMBER

(75) Inventors: Toshihito Takeuchi, Utsunomiya (JP); Daisuke Imanishi, Utsunomiya (JP); Yasushi Mukaiyama, Oyama (JP); Takeshi Wake, Tochigi-ken (JP); Yuji Ohara, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 774 days.

(21) Appl. No.: 12/419,709

(22) Filed: Apr. 7, 2009

(65) Prior Publication Data

US 2009/0260208 A1 Oct. 22, 2009

(30) Foreign Application Priority Data

Apr. 16, 2008 (JP) ..... 2008-106863
Jan. 8, 2009 (JP) ..... 2009-002763

(51) Int. Cl.
*B21D 39/04* (2006.01)

(52) U.S. Cl. ..... 29/282; 294/86.4; 123/193.2

(58) Field of Classification Search ..... 29/44, 251–253, 29/255, 260
See application file for complete search history.

(56) References Cited

U.S. PATENT DOCUMENTS 4,370,788 A * 2/1983 Baker ..... 29/888.061
4,552,397 A * 11/1985 Conrad ..... 294/86.4
4,776,078 A * 10/1988 Howard et al. ..... 29/252
5,539,981 A * 7/1996 Burcham et al. ..... 29/888.061
6,386,103 B1 * 5/2002 Charette et al. ..... 101/375
7,331,288 B2 * 2/2008 Gottling et al. ..... 101/480
7,383,805 B2 * 6/2008 Michioka et al. ..... 123/193.2

FOREIGN PATENT DOCUMENTS

JP 2000-197954 A 7/2000

* cited by examiner

*Primary Examiner* — Monica Carter
*Assistant Examiner* — Melanie Alexander
(74) *Attorney, Agent, or Firm* — Arent Fox LLP

(57) ABSTRACT

An apparatus holds a plurality of hollow cylindrical members and pushes off the hollow cylindrical members. The apparatus includes a holder shaft for holding the hollow cylindrical members in tandem thereon, a gripper member projecting outwardly from a side wall surface of the holder shaft and engaging an inner wall surface of a foremost one of the hollow cylindrical members, a cam disposed in the holder shaft for displacing the gripper member, a pusher cylinder for pressing an end face of a rearmost one of the hollow cylindrical members and moving all the hollow cylindrical members forward, to release the foremost one of the hollow cylindrical members from the holder shaft and position a next one of the hollow cylindrical members as a new foremost one of the hollow cylindrical members, and a turning cylinder for turning the holder shaft.

4 Claims, 12 Drawing Sheets

APPARATUS FOR PUSHING HOLLOW CYLINDRICAL MEMBER

BACKGROUND OF THE INVENTION

1. Field of the Invention

The present invention relates to an apparatus for pushing a plurality of hollow cylindrical members into predetermined positions, respectively.

2. Description of the Related Art

As well known in the art, cylinder blocks manufactured in the automotive industry are a component of an internal combustion engine used as a propulsive source for automobiles. In many cases, cylinder sleeves are inserted in respective bores defined in the cylinder block. When the internal combustion engine is in operation, pistons which move back and forth in the respective cylinder bores have their outer side wall surfaces held in sliding contact with the inner wall surfaces of the cylinder sleeves.

The cylinder sleeves are inserted in the respective bores by insert casting. Specifically, after the cylinder sleeves are placed in given positions within a casting mold, a molten metal is poured into the casting mold around the cylinder sleeves, and then cooled into a solid cylinder block with the cylinder sleeves enveloped therein.

One known apparatus for inserting cylinder sleeves into given positions within a casting mold is disclosed in Japanese Laid-Open Patent Publication No. 2000-197954. The disclosed inserting apparatus has a first inserting mechanism for inserting cylinder sleeves into respective portions in a V-type internal combustion engine in which at least two bores are arranged in a V-shaped configuration, and a second inserting mechanism for inserting cylinder sleeves into respective portions in a straight internal combustion engine in which all the bores are aligned inline. The first inserting mechanism has a lower inserting unit and an upper inserting unit. For example, for a six-cylinder V-type internal combustion engine in which two sets of three bores are arranged in parallel, three cylinder sleeves are inserted into one array of three cylinders with the lower inserting unit, and other three cylinder sleeves are inserted into another array of three cylinders with the upper inserting unit.

In an inserting apparatus constituted as the one disclosed in Japanese Laid-Open Patent Publication No. 2000-197954, if the number of engine cylinders involved increases, then the number of cylinder sleeves to be held by the lower inserting mechanism or the upper inserting mechanism needs to be increased. As a result, the disclosed inserting apparatus becomes more complex in structure and greater in weight. The process of servicing the inserting apparatus for maintenance also becomes tedious and time-consuming.

In addition, the inserting apparatus includes a sleeve supply station having two different sleeve supply mechanisms for supplying cylinder sleeves to the first inserting mechanism and the second inserting mechanism. The two different sleeve supply mechanisms tend to make the inserting apparatus complex in structure.

SUMMARY OF THE INVENTION

It is an object of the present invention to provide a hollow cylindrical member pushing apparatus which is relatively simple in structure and is capable of inserting hollow cylindrical members easily into predetermined positions.

To achieve the above object, there is provided in accordance with the present invention an apparatus for holding a plurality of hollow cylindrical members and pushing off the hollow cylindrical members, comprising a holder shaft for holding the hollow cylindrical members in tandem thereon, a gripper member projecting outwardly from a side wall surface of the holder shaft and engaging an inner wall surface of a foremost one of the hollow cylindrical members held on the holder shaft, a cam disposed in the holder shaft for displacing the gripper member, pushing means for pressing an end face of a rearmost one of the hollow cylindrical members held by the holder shaft and moving all the hollow cylindrical members forward, to release the foremost one of the hollow cylindrical members from the holder shaft and position a next one of the hollow cylindrical members as a new foremost one of the hollow cylindrical members on the holder shaft, and turning means for turning the holder shaft.

The hollow cylindrical members that are held in tandem mean that the hollow cylindrical members are kept end to end on the holder shaft.

The holder shaft can hold at least two hollow cylindrical members thereon and allows the hollow cylindrical members to be individually released therefrom. As the number of holder shafts does not need to be increased depending on the total number of hollow cylindrical members involved, the apparatus, i.e., the hollow cylindrical member pushing apparatus, is simple in structure, light in weight, and low in cost. Since the hollow cylindrical member pushing apparatus is simple in structure, it can easily be serviced for maintenance.

Inasmuch as the holder shaft is capable of holding a plurality of hollow cylindrical members, the hollow cylindrical member pushing apparatus can smoothly push and insert the hollow cylindrical members into predetermined positions.

After the foremost one of the hollow cylindrical members is released from the holder shaft and the next one of the hollow cylindrical members is positioned as the new foremost one of the hollow cylindrical members on the holder shaft, the turning means is actuated to turn the holder shaft, and then the pushing means pushes the end face of the rearmost one of the hollow cylindrical members to release only the new foremost one of the hollow cylindrical members from the holder shaft. The hollow cylindrical members thus released can be placed in different positions.

The hollow cylindrical member pushing apparatus may have a plurality of holder shafts. The plural holder shafts make it possible to hold and push more hollow cylindrical members simultaneously.

Each of the hollow cylindrical members may comprise a cylinder sleeve to be enclosed in a cylinder block by insert casting.

According to the present invention, the holder shaft holds the hollow cylindrical members in tandem and allows the hollow cylindrical members to be individually released therefrom. As the number of holder shafts does not need to be increased depending on the total number of hollow cylindrical members involved, the hollow cylindrical member pushing apparatus is simple in structure.

After the foremost hollow cylindrical member is released from the hollow shaft, the turning means operates to turn the hollow shaft, and then the next hollow cylindrical member is released from the hollow shaft. Accordingly, the hollow cylindrical members which are individually released from the holder shaft can be placed in different positions.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

A hollow cylindrical member pushing apparatus according to an embodiment of the present invention will be described in detail below with reference to the accompanying drawings. In the embodiment described below, cylinder sleeves for use in an engine cylinder block will be illustrated as hollow cylindrical members.

Figure 1:
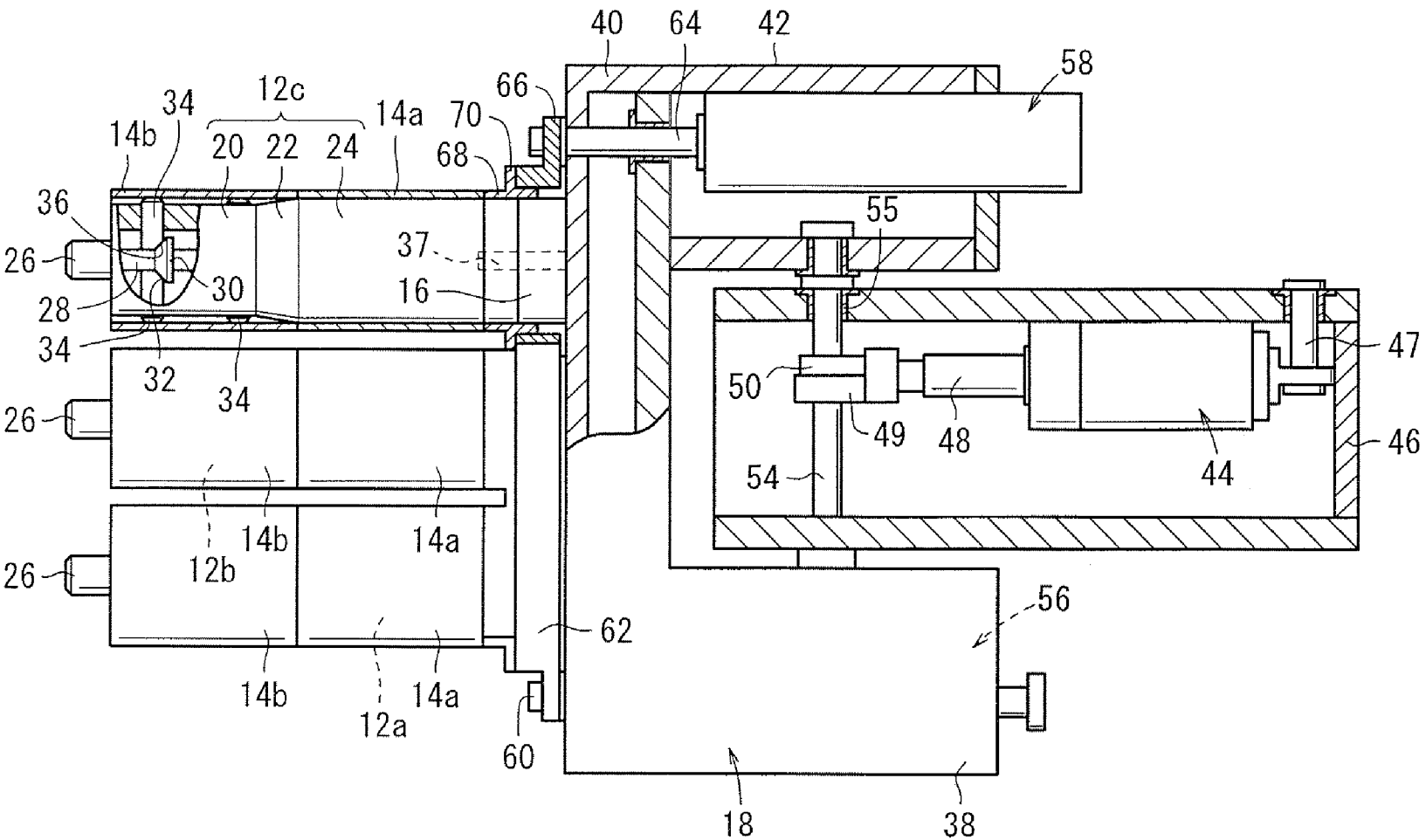
FIG. 1 is a side elevational view, partly in cross section, of a hollow cylindrical member pushing apparatus according to an embodiment of the present invention.
Figure 2:
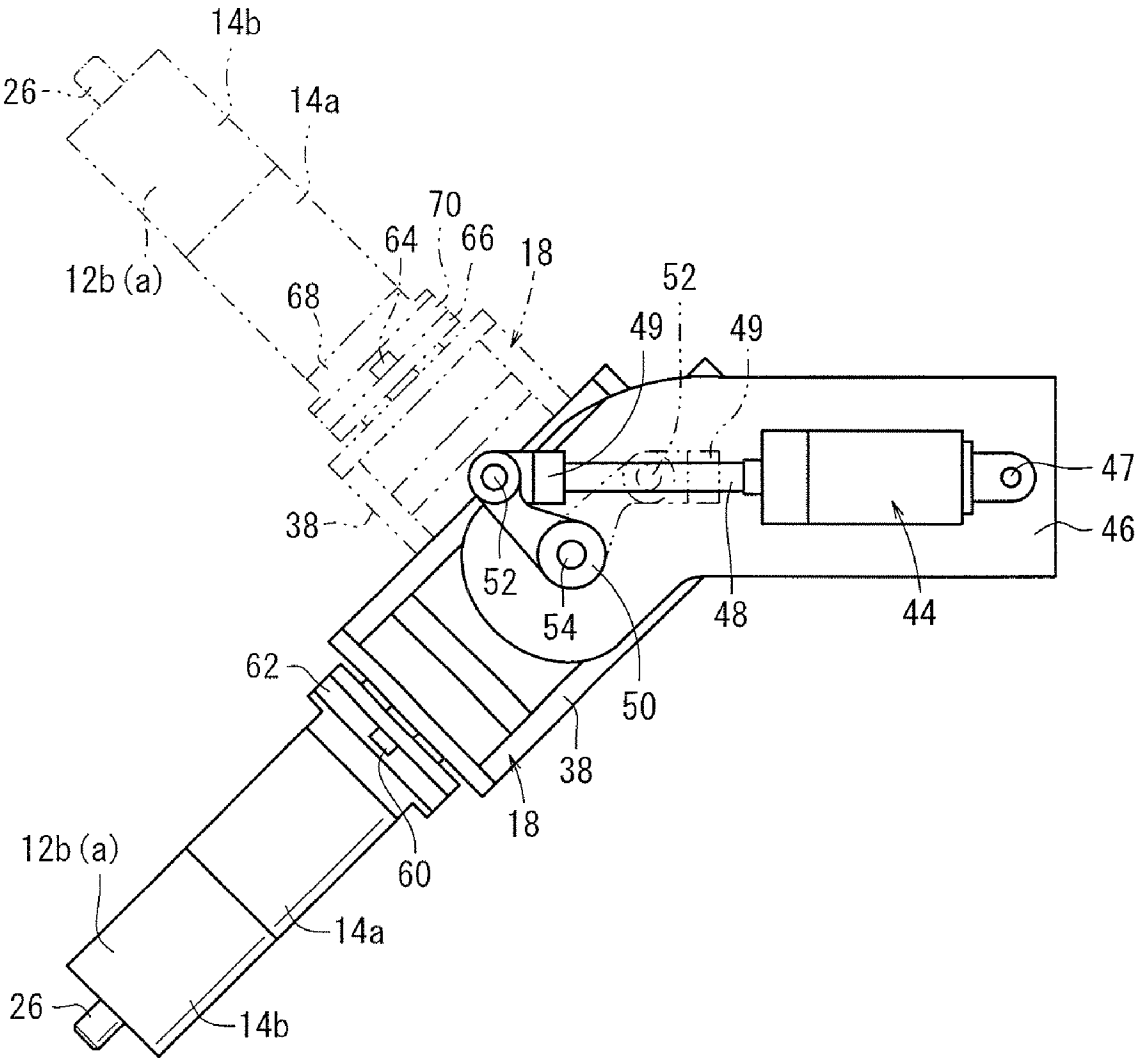
FIG. 2 is a plan view, partly cut away, of the hollow cylindrical member pushing apparatus shown in FIG. 1.

FIG. 1 is a side elevational view, partly in cross section, of a hollow cylindrical member pushing apparatus 10 according to the present embodiment, and FIG. 2 is a plan view, partly cut away, of the hollow cylindrical member pushing apparatus 10 shown in FIG. 1. The hollow cylindrical member pushing apparatus 10 has a first holder shaft 12*a*, a second holder shaft 12*b*, and a third holder shaft 12*c*, to be described later, for holding cylinder sleeves. In FIG. 1, the first holder shaft 12*a*, the second holder shaft 12*b*, and the third holder shaft 12*c* are shown as being in a central position in their angularly movable range. In FIG. 2, the first holder shaft 12*a*, the second holder shaft 12*b*, and the third holder shaft 12*c* are shown as being fully angularly moved in their angularly movable range.

Each of the first holder shaft 12*a*, the second holder shaft 12*b*, and the third holder shaft 12*c*, which are arrayed parallel to each other, can hold two cylinder sleeves 14*a*, 14*b* in tandem, i.e., end to end. The hollow cylindrical member pushing apparatus 10 has a support block 18 which supports the first holder shaft 12*a*, the second holder shaft 12*b*, and the third holder shaft 12*c* on respective attachment jigs 16. The first holder shaft 12*a*, the second holder shaft 12*b*, and the third holder shaft 12*c* extend horizontally from the support block 18 and are successively arrayed vertically in this order.

The cylinder sleeves 14*a*, 14*b* are identical in structure and shape to each other. For illustrative purpose, the cylinder sleeve denoted "14*a*" is supported closely to the proximal end of each of the first holder shaft 12*a*, the second holder shaft 12*b*, and the third holder shaft 12*c* and positioned as a rearmost one. The cylinder sleeve denoted "14*b*" is supported closely to the distal end of each of the first holder shaft 12*a*, the second holder shaft 12*b*, and the third holder shaft 12*c* and positioned as a foremost one.

Figure 3:
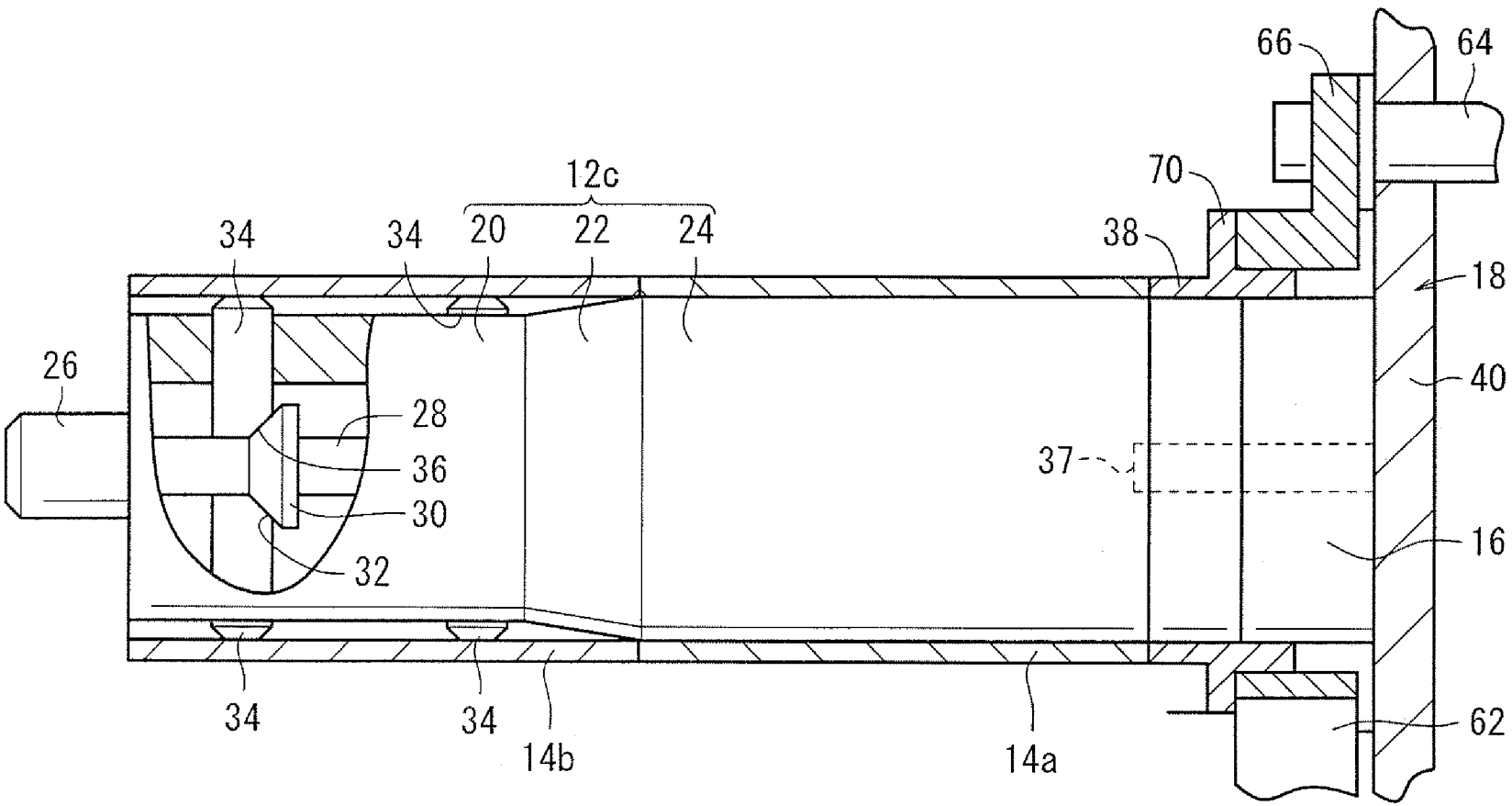
FIG. 3 is an enlarged side elevational view, partly in cross section and cut away, of a third holder shaft.

FIG. 3 shows the third holder shaft 12*c* by way of illustrative example. As shown in FIG. 3, the third holder shaft 12*c* includes a smaller-diameter portion 20, a tapered portion 22, and a larger-diameter portion 24 which are successively arranged from its distal end toward its proximal end. The larger-diameter portion 24 is coupled to the support block 18 by the attachment jig 16. The first holder shaft 12*a*, the second holder shaft 12*b*, and the third holder shaft 12*c* are mounted on the support block 18 by a floating structure.

A cylindrical positioning knob 26 is disposed on the outer front end surface of the distal end of the smaller-diameter portion 20. The third holder shaft 12*c* is of a hollow structure with a rod-shaped shank 28 extending coaxially therein. The rod-shaped shank 28 supports a presser cam 30 mounted thereon within the smaller-diameter portion 20. The presser cam 30 has a tapered surface 32 facing toward the distal end of the smaller-diameter portion 20.

The smaller-diameter portion 20 supports a pair of diametrically opposite, i.e., 180°-spaced, axially movable gripper pins (gripping members) 34 having respective outer ends projecting radially outwardly from outer side wall surfaces of the smaller-diameter portion 20. The gripper pins 34 have respective inner ends positioned within the smaller-diameter portion 20 and having respective tapered surfaces 36 held in sliding contact with the tapered surface 32 of the presser cam 30. The presser cam 30 and the gripper pins 34, described above, are positioned closely to the distal end of the smaller-diameter portion 20. The smaller-diameter portion 20 supports another pair of diametrically opposite, i.e., 180°-spaced, axially movable gripper pins (gripping members) 34 positioned closely to the proximal end of the smaller-diameter portion 20.

A spring retainer, not shown, is mounted on the rod-shaped shank 28 within the larger-diameter portion 24. A helical spring, also not shown, is placed between the spring retainer and the larger-diameter portion 24 for normally biasing the rod-shaped shank 28 to move in a direction toward the cylindrical positioning knob 26.

The distance between the outer front end surface of the distal end of the smaller-diameter portion 20 and the boundary between the tapered portion 22 and the larger-diameter portion 24 is substantially the same as the axial length of the cylinder sleeve 14*b*. Similarly, the distance between the boundary between the tapered portion 22 and the larger-diameter portion 24 and the distal end of the attachment jig 16 is also substantially the same as the axial length of the cylinder sleeve 14*a*.

The attachment jig 16 is combined with a sensor 37 for detecting whether the cylinder sleeve 14*a* is held on the third holder shaft 12*c* or not.

Since the first holder shaft 12*a* and the second holder shaft 12*b* are identical to the third holder shaft 12*c*, the first holder shaft 12*a* and the second holder shaft 12*b* will not be described in detail below.

As shown in FIG. 1, the support block 18 comprises a first horizontal portion 38, an upstanding portion 40 extending upwardly from the first horizontal portion 38, and a second horizontal portion 42 extending from an upper end of the upstanding portion 40 parallel to the first horizontal portion 38. The support block 18 is of an essentially C-shaped structure as viewed in side elevation. A turning cylinder 44 as a turning means for angularly moving the first through third holder shafts 12*a*, 12*b*, 12*c* together with the support block 18 is disposed between the first horizontal portion 38 and the second horizontal portion 42.

As shown in FIG. 2, the turning cylinder 44 is enclosed in a casing 46 and has an end supported on the casing 46 by a joint shaft 47. In the illustrated embodiment, the turning cylinder 44 is slightly offset upwardly from the longitudinal central axis of the casing 46.

The turning cylinder 44 has a piston rod 48 connected to a first link 49 that is operatively connected to a second link 50. As shown in FIGS. 1 and 2, a first bar 52 is inserted into the first link 49. The first bar 52 rotatably supports the connection between the first link 49 and the second link 50.

The second link 50 has one end connected to the first link 49 and the other end which is spaced from the extending direction of the piston rod 48. A second bar 54 extends vertically through a through hole defined in the other end of the second link 50 and also extends from an upper surface of the first horizontal portion 38 to an lower surface of the second horizontal portion 42 through the casing 46. The casing 46 and the support block 18 are supported. In FIG. 1, reference numeral 55 designates a bearing.

As shown in FIG. 1, the first horizontal portion 38 and the second horizontal portion 42 house therein a first pusher cylinder 56 and a second pusher cylinder 58, respectively, each serving as a pushing means. The first pusher cylinder 56 has a piston rod 60 connected to a first pusher guide 62. The first pusher guide 62 covers the attachment jig 16 coupled to the first holder shaft 12*a* and the attachment jig 16 coupled to the second holder shaft 12*b*. The second pusher cylinder 58 has a piston rod 64 fitted into a second pusher jig 66 which is inverted-L-shaped as viewed in side elevation.

A hollow cylindrical second pusher guide 68 is fitted over the attachment jig 16 coupled to the third holder shaft 12*c*. The second pusher guide 68 has a radially outwardly extending flange 70 on its axially intermediate portion. The flange 70 is held in abutting engagement with the first pusher guide 62 at a position which is diametrically opposite to, i.e., 180°-spaced from, the position where the flange 70 is also held in abutting engagement with the second pusher jig 66.

The hollow cylindrical member pushing apparatus 10 according to the present embodiment is basically constructed as described above. Operation and advantages of the hollow cylindrical member pushing apparatus 10 will be described below.

Figure 4:
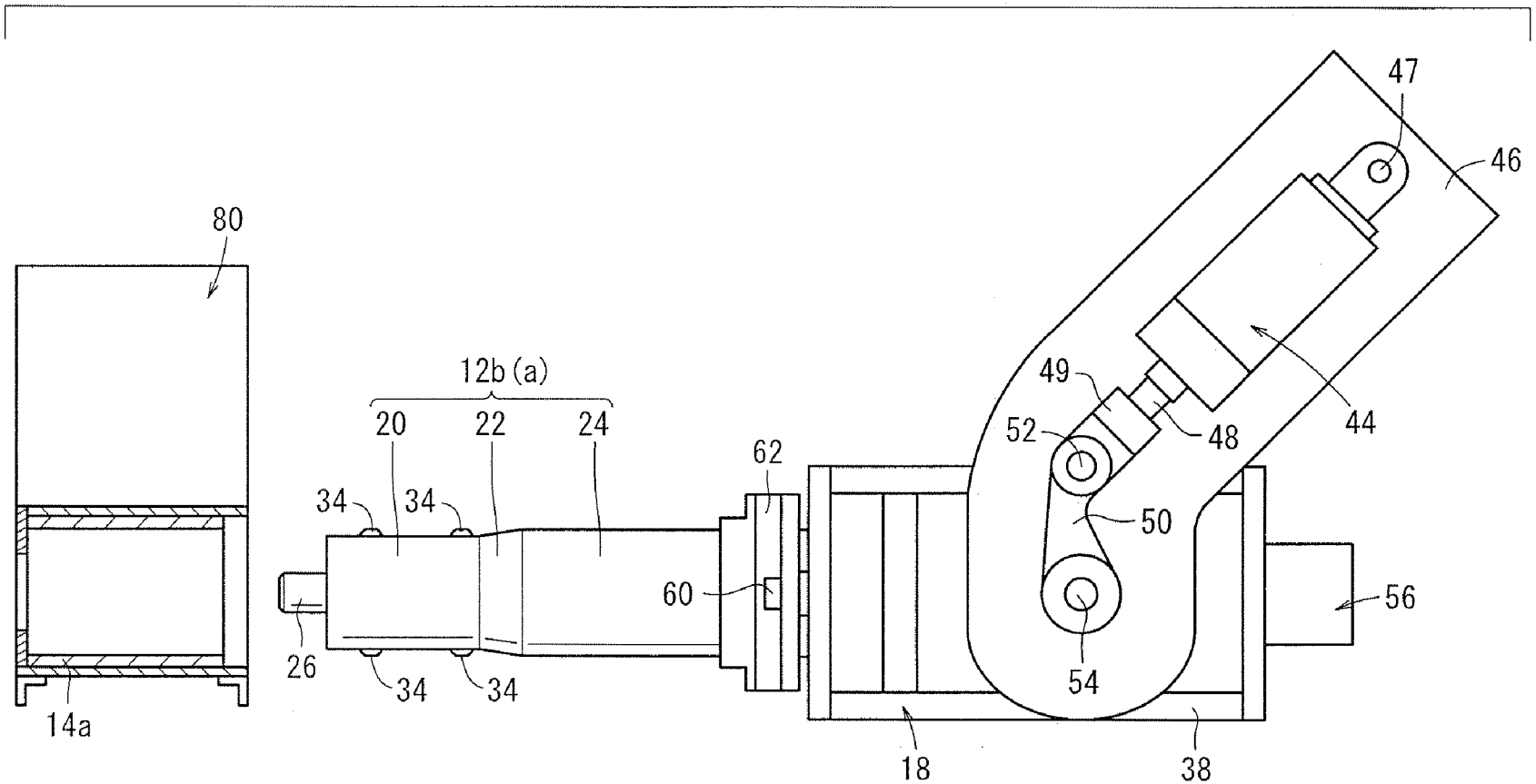
FIG. 4 is a schematic diagram, partly in cross section and cut away, showing the manner in which first through third holder shafts are in a standby position before they hold respective cylinder sleeves.
Figure 5:
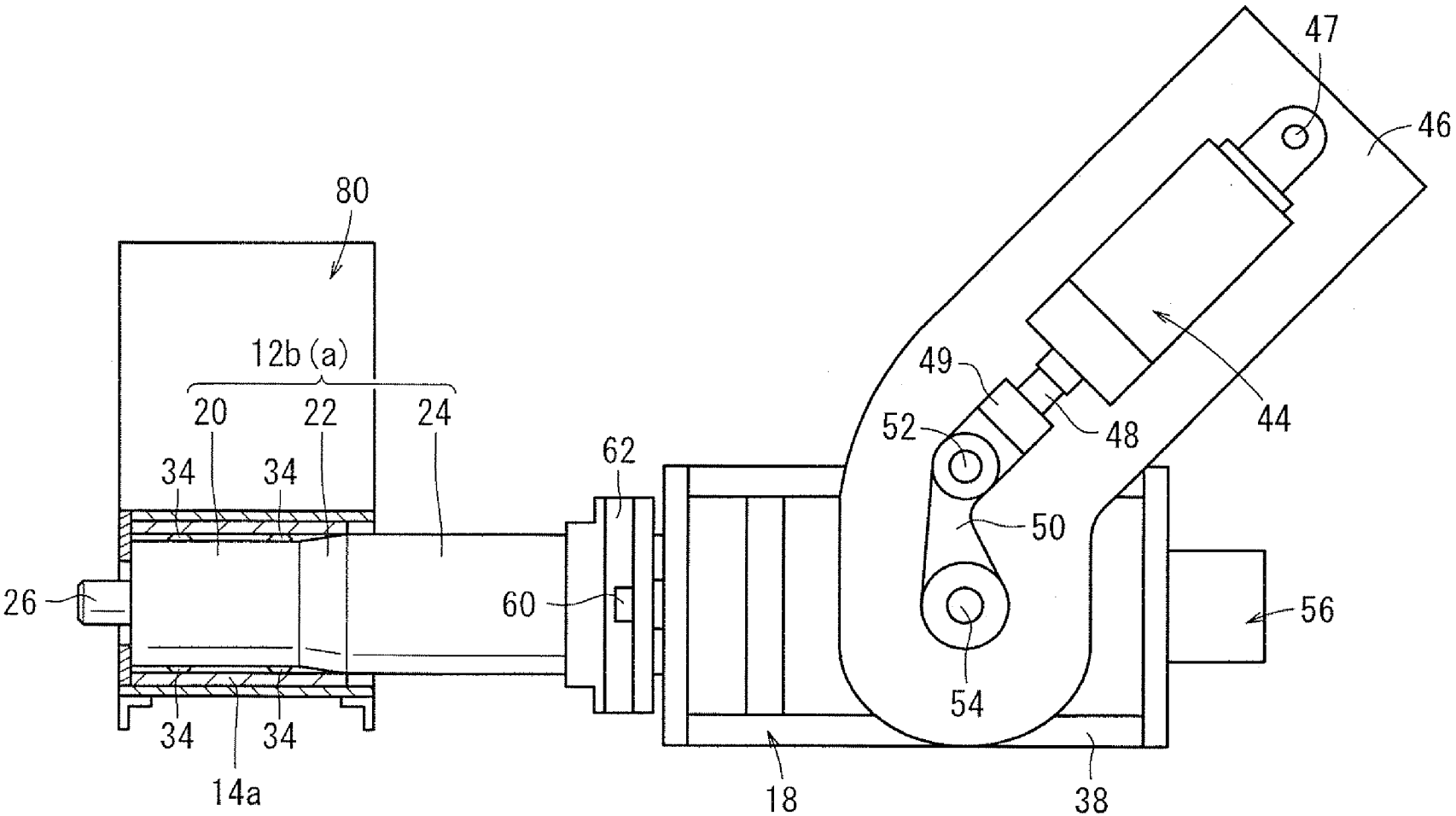
FIG. 5 is a schematic diagram, showing the manner in which the first through third holder shafts hold respective cylinder sleeves of a first array.

As shown in FIG. 4, while the hollow cylindrical member pushing apparatus 10 is being retracted from a sleeve supply mechanism 80, a set of three cylinder sleeves 14*a* is supplied to the sleeve supply mechanism 80. Then, as shown in FIG. 5, the hollow cylindrical member pushing apparatus 10 is displaced to the sleeve supply mechanism 80 to insert the first through third holder shafts 12*a*, 12*b*, 12*c* into the respective cylinder sleeves 14*a*. When the smaller-diameter portions 20 of the first through third holder shafts 12*a*, 12*b*, 12*c* are inserted respectively into the cylinder sleeves 14*a*, the inner wall surfaces of the cylinder sleeves 14*a* press the gripper pins 34 radially inwardly. The gripper pins 34 are retracted radially inwardly into the smaller-diameter portions 20, causing the tapered surfaces 36 to push the corresponding tapered surfaces 32 of the presser cams 30 in sliding contact therewith. The presser cams 30 and hence the rod-shaped shank 28 are axially displaced rearward, whereupon the spring retainer on the rod-shaped shank 28 compresses the helical spring.

Figure 6:
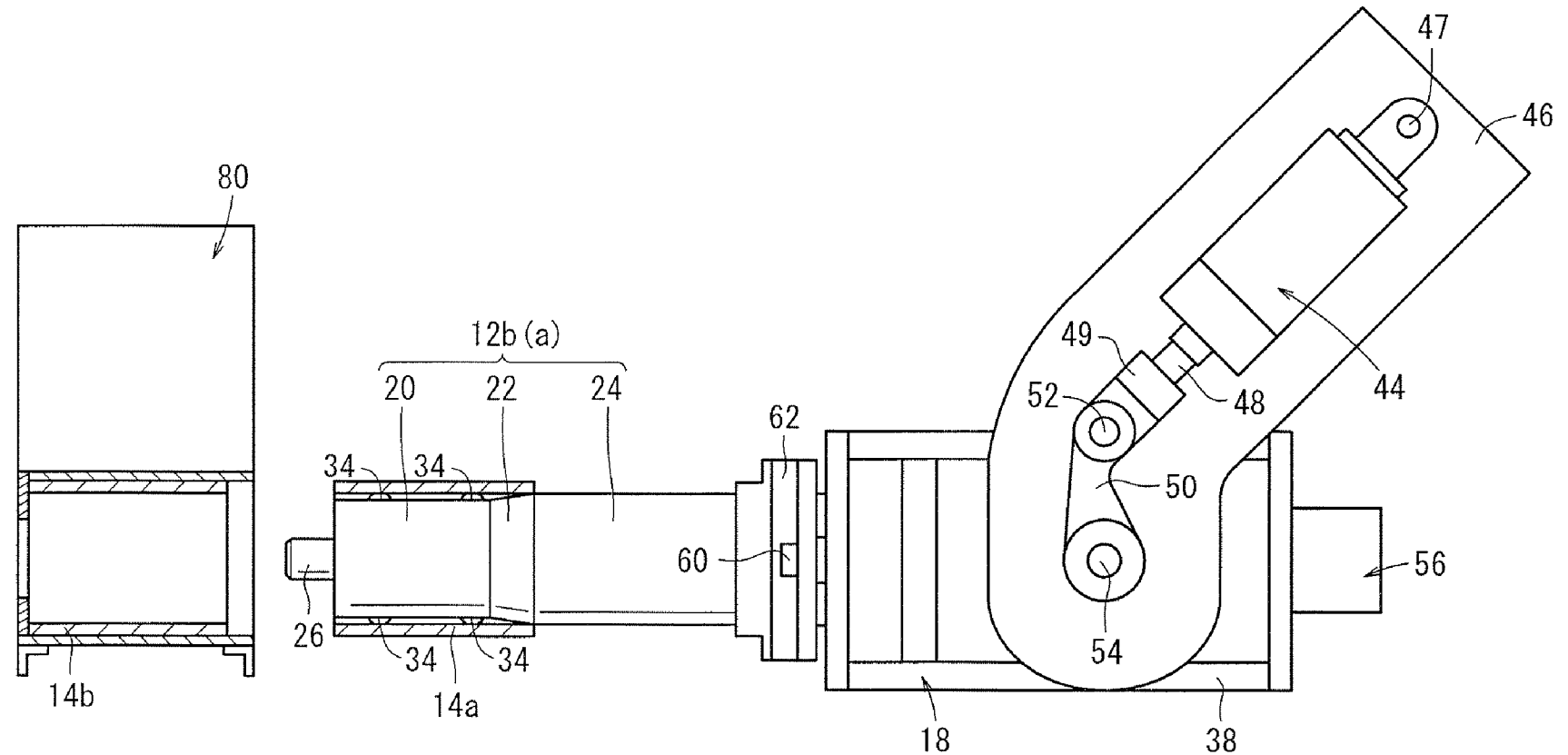
FIG. 6 is a schematic diagram, showing the manner in which the first through third holder shafts are retracted while holding the respective cylinder sleeves of the first array.

Thereafter, as shown in FIG. 6, the hollow cylindrical member pushing apparatus 10 is retracted from the sleeve supply mechanism 80. At the same time, the sleeve supply mechanism 80 is supplied with a new set of three cylinder sleeves 14*b*.

Figure 7:
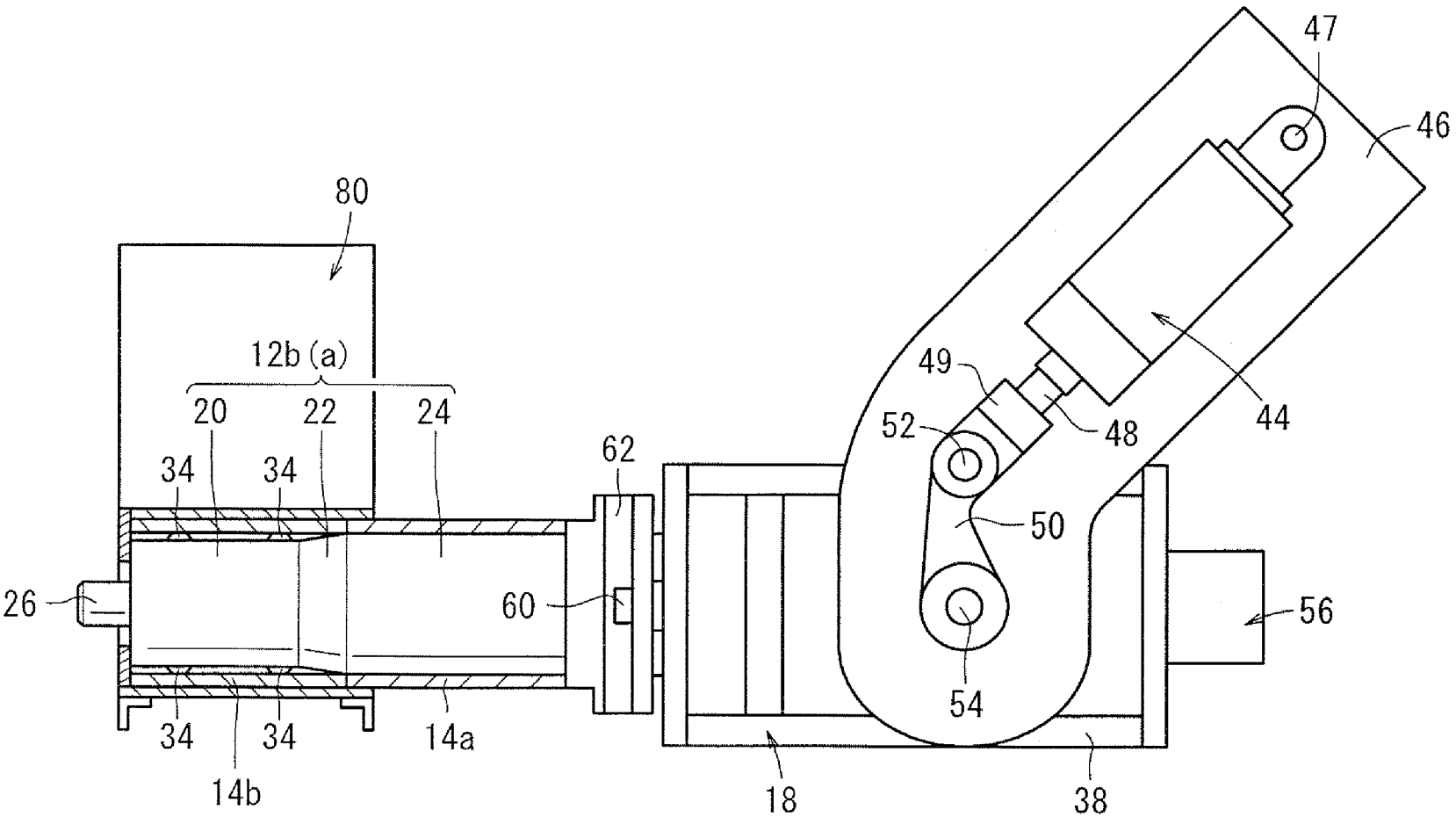
FIG. 7 is a schematic diagram, showing the manner in which the first through third holder shafts hold respective cylinder sleeves of a second array.

The hollow cylindrical member pushing apparatus 10 is displaced again toward the sleeve supply mechanism 80 to insert the first through third holder shafts 12*a*, 12*b*, 12*c* into the respective cylinder sleeves 14*b*. When the smaller-diameter portions 20 of the first through third holder shafts 12*a*, 12*b*, 12*c* are inserted respectively into the cylinder sleeves 14*b*, as shown in FIG. 7, the cylinder sleeves 14*b* push the previously installed cylinder sleeves 14*a* to a position over the larger-diameter portions 24 of the first through third holder shafts 12*a*, 12*b*, 12*c*. Now, two cylinder sleeves 14*a*, 14*b* are retained on each of the first through third holder shafts 12*a*, 12*b*, 12*c*, so that a total of six cylinder sleeves are retained on the first through third holder shafts 12*a*, 12*b*, 12*c*.

Figure 8:
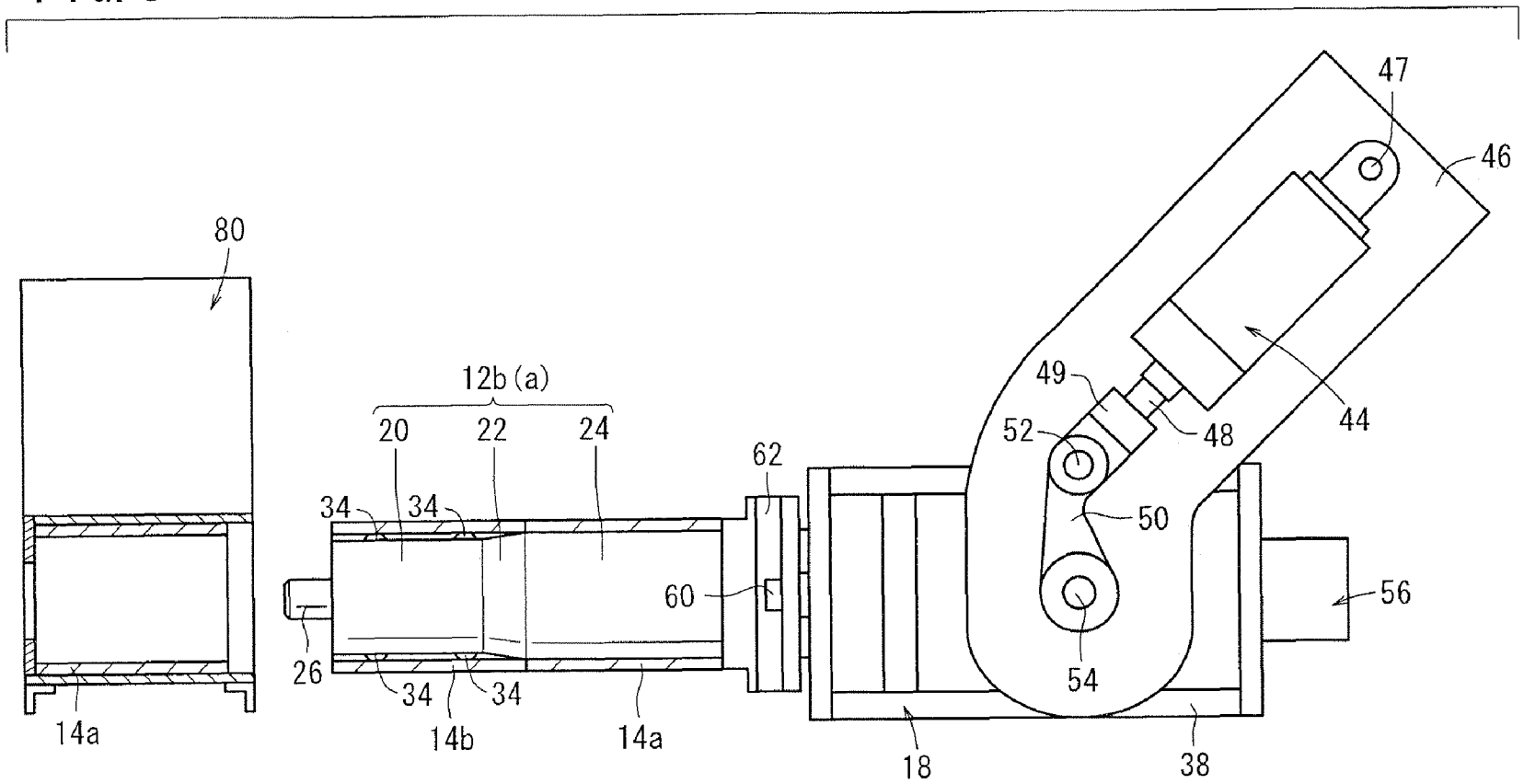
FIG. 8 is a schematic diagram, showing the manner in which the first through third holder shafts are retracted while holding the respective cylinder sleeves of the second array.
Figure 9:
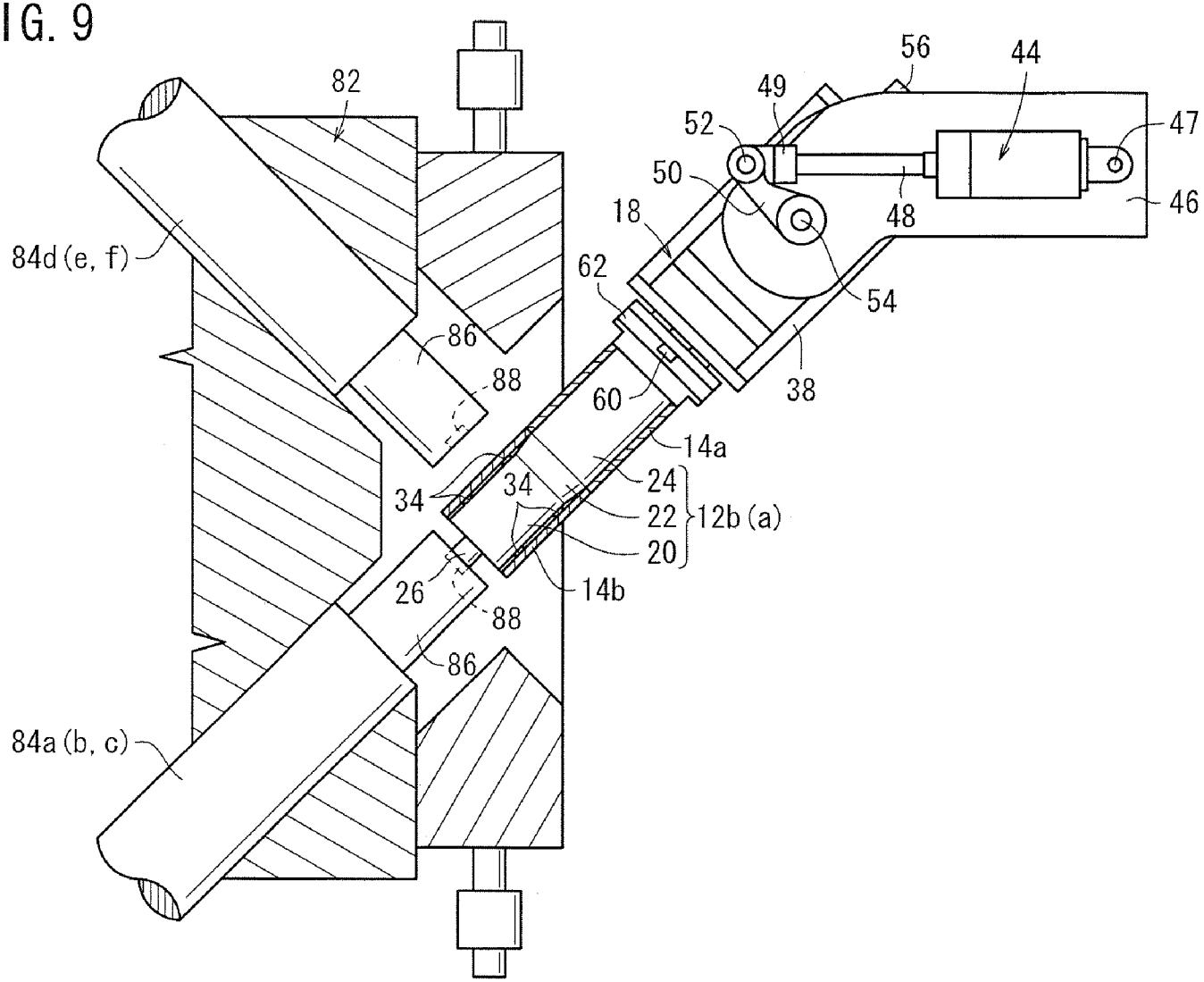
FIG. 9 is a schematic diagram, showing the manner in which the first through third holder shafts face respective retainer pins to which the respective cylinder sleeves of the second array are to be transferred.

Then, as shown in FIG. 8, the hollow cylindrical member pushing apparatus 10 is spaced away from the sleeve supply mechanism 80. Thereafter, as shown in FIG. 9, the hollow cylindrical member pushing apparatus 10 is moved to a casting mold assembly 82. The casting mold assembly 82 has a total of six holder pins 84*a* through 84*f* for holding cylinder sleeves 14*a*, 14*b*. Specifically, the casting mold assembly 82 includes an array of three parallel holder pins 84*a*, 84*b*, 84*c* and another array of three parallel holder pins 84*d*, 84*e*, 84*f*.

The first through third holder shafts 12*a*, 12*b*, 12*c* of the hollow cylindrical member pushing apparatus 10 are initially held in facing relation to the holder pins 84*a*, 84*b*, 84*c*, respectively, in axial alignment therewith. At this time, the piston rod 48 of the turning cylinder 44 is fully extended over its maximum stroke.

Figure 10:
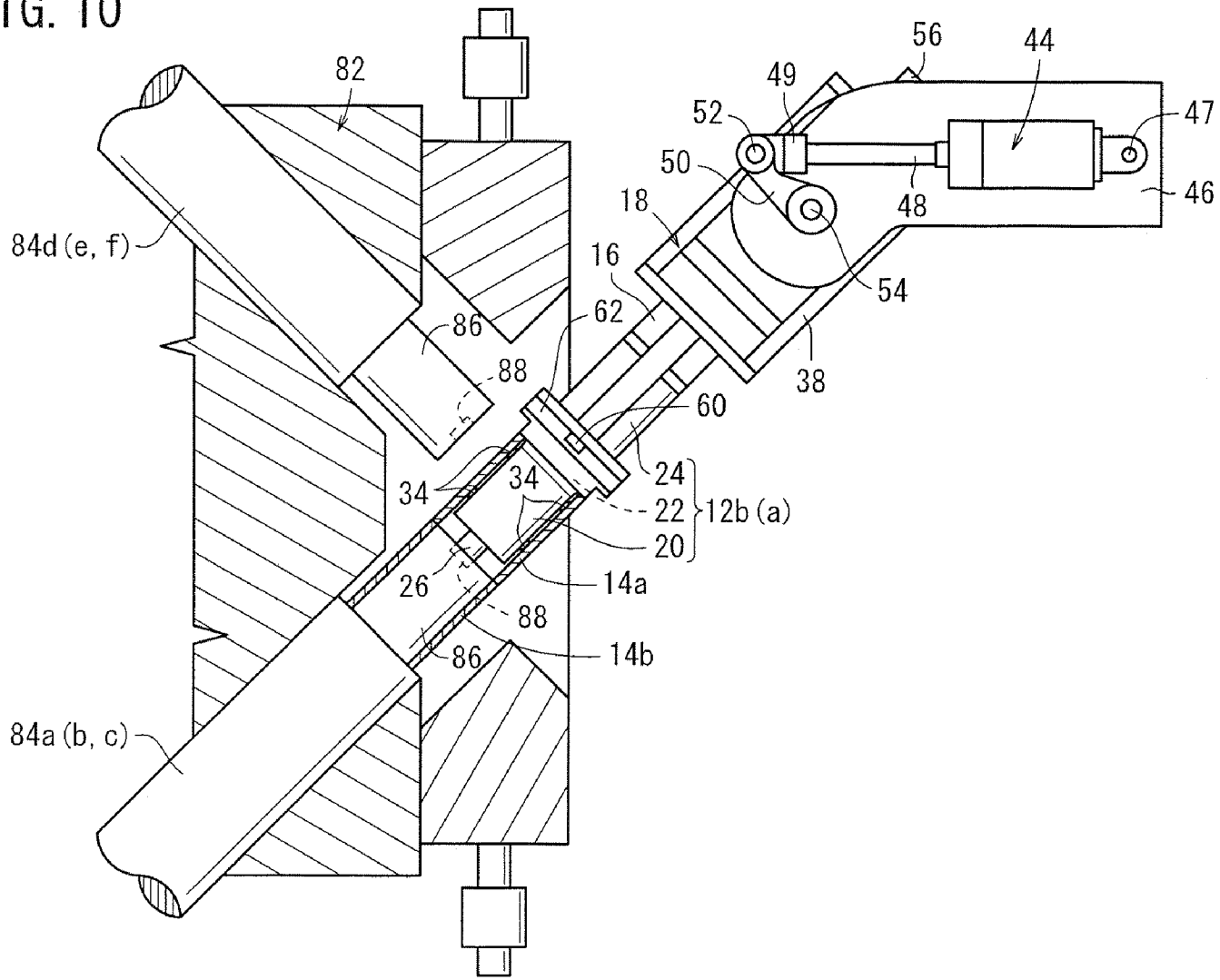
FIG. 10 is a plan view, partly in cross section and cut away, showing the manner in which the respective cylinder sleeves of the second array are individually transferred from the first through third holder shafts to the respective retainer pins.

The holder pins 84*a* through 84*f* have respective smaller-diameter holding end portions 86. The smaller-diameter holding end portions 86 have respective recesses 88 defined in their respective end faces. The cylindrical positioning knobs 26 of the first, second, and third holder shafts 12*a*, 12*b*, 12*c* are placed respectively in the recesses 88 of the holder pins 84*a*, 84*b*, 84*c*. As shown in FIG. 10, the piston rods 60, 64 of the first pusher cylinder 56 and the second pusher cylinder 58 are synchronously extended. The piston rod 60 of the first pusher cylinder 56 causes the first pusher guide 62, and the piston rod 64 of the second pusher cylinder 58 causes the second pusher jig 66 and the second pusher guide 68, to push the cylinder sleeves 14*a* which have initially been held on the first, second, and third holder shafts 12*a*, 12*b*, 12*c*. When the cylinder sleeves 14*a* are pushed along the first, second, and third holder shafts 12*a*, 12*b*, 12*c*, they push the subsequently held cylinder sleeves 14*b* off the first, second, and third holder shafts 12*a*, 12*b*, 12*c* onto the smaller-diameter holding end portions 86 of the holder pins 84*a*, 84*b*, 84*c*.

Figure 11:
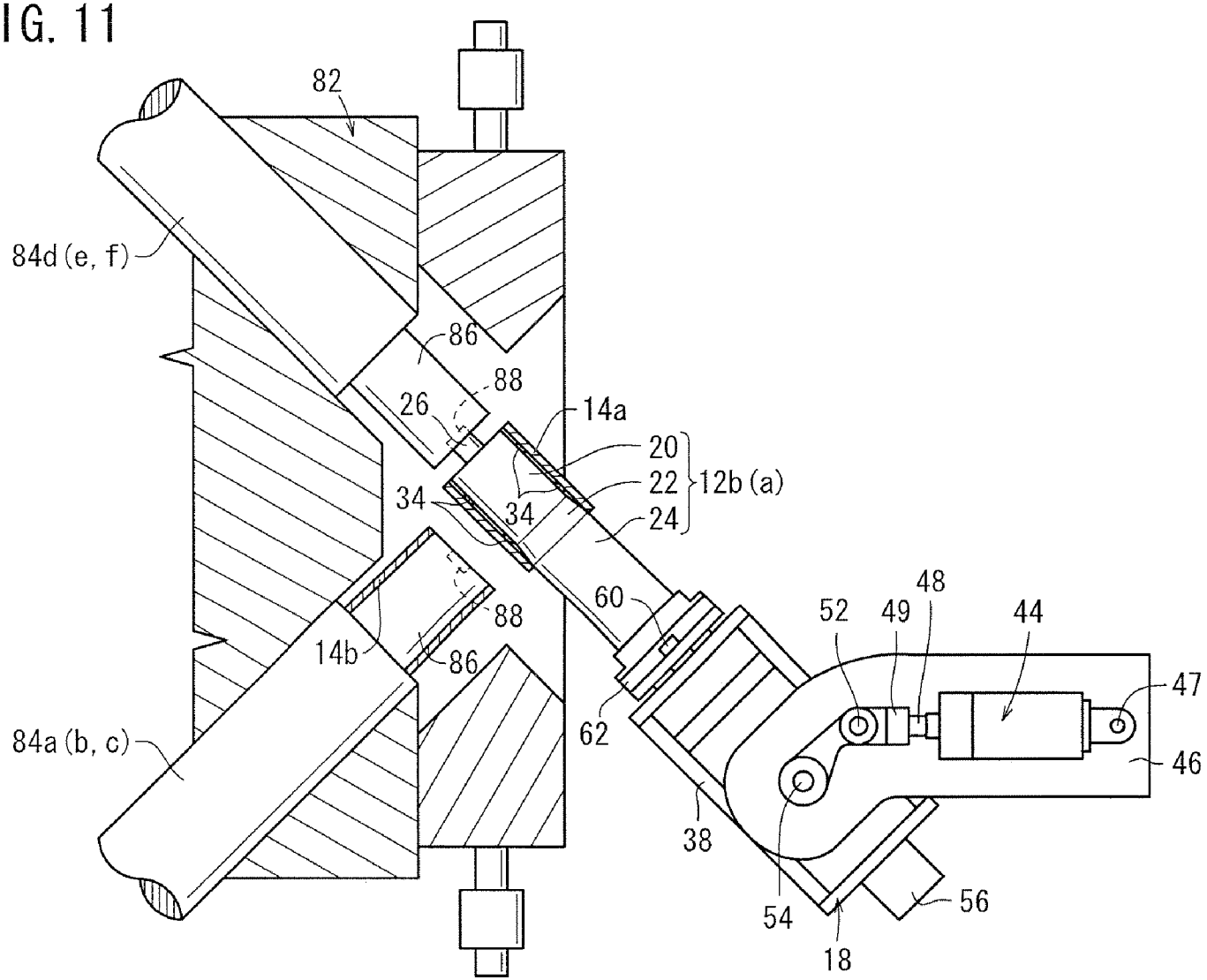
FIG. 11 is a plan view, partly in cross section and cut away, showing the manner in which the first through third holder shafts face respective retainer pins to which the respective cylinder sleeves of the first array are to be transferred.

After the cylinder sleeves 14*b* are fitted over the smaller-diameter holding end portions 86 of the holder pins 84*a*, 84*b*, 84*c*, the hollow cylindrical member pushing apparatus 10 is displaced to a predetermined position, and the piston rod 48 of the turning cylinder 44 is retracted. Since the first link 49 is coupled to the one end of the second link 50 by the first bar 52 and the other end of the second link 50 is coupled to the casing 46 and the support block 18 by the second bar 54, the support block 18 is angularly moved about the second bar 54 until the first through third holder shafts 12*a*, 12*b*, 12*c* brought into facing relation to the holder pins 84*d*, 84*e*, 84*f*, respectively, in axial alignment therewith, as shown in FIG. 11.

Figure 12:
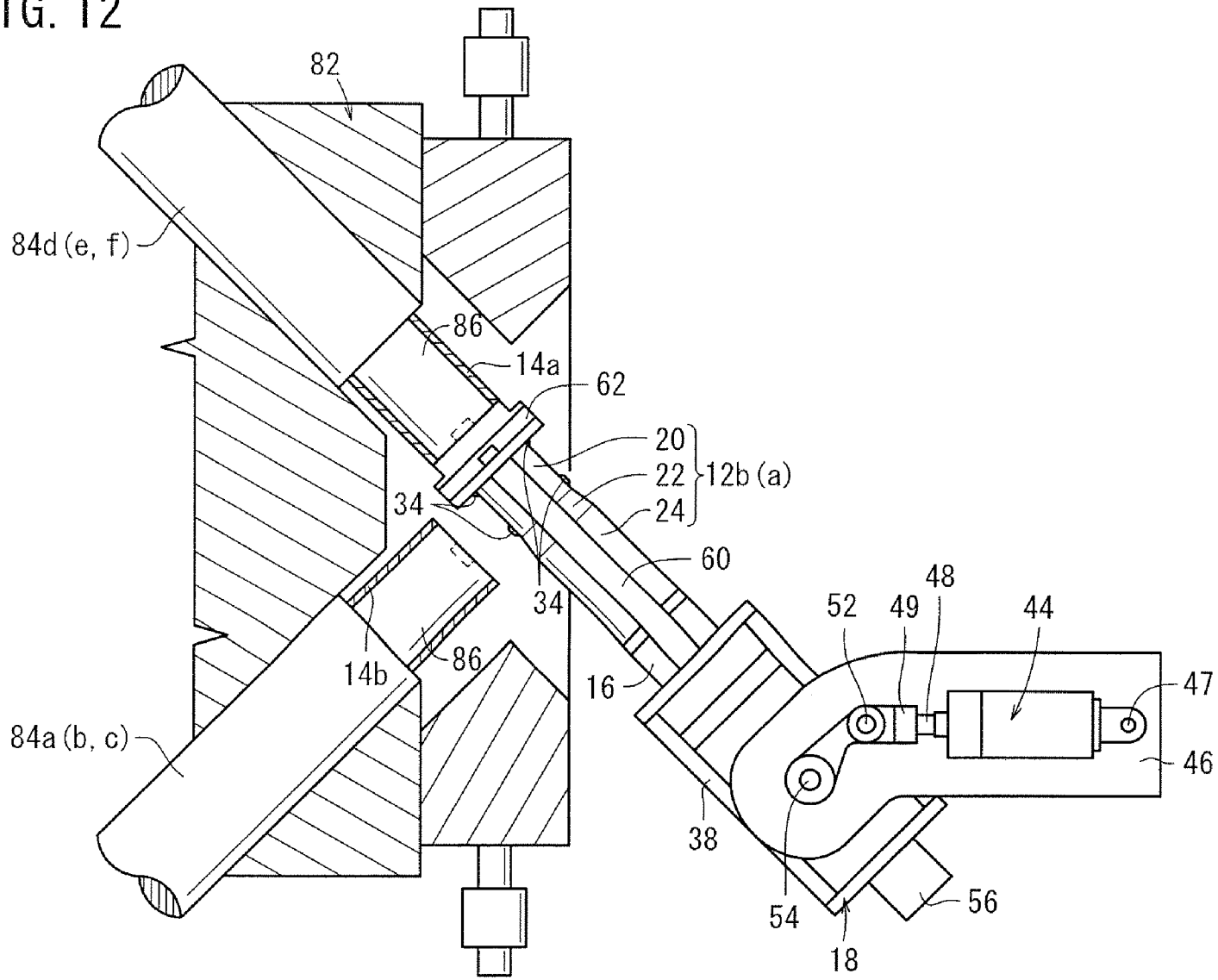
FIG. 12 is a plan view, partly in cross section and cut away, showing the manner in which the respective cylinder sleeves of the first array are individually transferred from the first through third holder shafts to the respective retainer pins.

Then, the piston rods 60, 64 of the first pusher cylinder 56 and the second pusher cylinder 58 are synchronously extended. As shown in FIG. 12, the initially held cylinder sleeves 14*a* are pushed off the first, second, and third holder shafts 12*a*, 12*b*, 12*c* onto the smaller-diameter holding end portions 86 of the holder pins 84*d*, 84*e*, 84*f*.

At the same time, the helical springs resiliently urge the respective spring retainers on the rod-shaped shanks 28 of the first, second, and third holder shafts 12*a*, 12*b*, 12*c*, moving the rod-shaped shanks 28 toward the distal ends thereof. The tapered surfaces 32 of the presser cams 30 slidingly push the tapered surfaces 36 of the gripper pins 34, causing the gripper pins 34 to move radially outwardly in directions to project from the first, second, and third holder shafts 12*a*, 12*b*, 12*c*.

According to the present embodiment, as described above, each of the first, second, and third holder shafts 12*a*, 12*b*, 12*c* can hold two cylinder sleeves 14*a*, 14*b* in tandem, and the two cylinder sleeves 14*a*, 14*b* can individually be released from each of the first, second, and third holder shafts 12*a*, 12*b*, 12*c*. As the number of holder shafts does not need to be increased depending on the total number of cylinder sleeves involved, the hollow cylindrical member pushing apparatus 10 is simple in structure, light in weight, and low in cost. Since the hollow cylindrical member pushing apparatus 10 is simple in structure, it can easily be serviced for maintenance.

In the illustrated embodiment, the hollow cylindrical member pushing apparatus 10 has three holder shafts 12*a*, 12*b*, 12*c*. However, the hollow cylindrical member pushing apparatus according to the present invention may have one or two holder shafts or more than three holder shafts.

In the illustrated embodiment, the cylinder sleeves 14*a*, 14*b* are illustrated as hollow cylindrical members. However, other members may be used as hollow cylindrical members. The hollow cylindrical member pushing apparatus 10 is not limited to being used with the casting mold assembly 82, but may be used in combination with other apparatus.

In the illustrated embodiment, each of the holder shafts includes two longitudinally spaced pairs of circumferentially spaced gripper pins 34, which means that the four gripper pins 34 are provided in total. However, each of the holder shafts may include three or more longitudinally spaced sets of three or more circumferentially spaced gripper pins 34.

Each of the first, second, and third holder shafts 12*a*, 12*b*, 12*c* may be of an axially increased length for holding three or more cylinder sleeves or hollow cylindrical members. The hollow cylindrical member pushing apparatus with the longer holder shafts for holding three or more cylinder sleeves or hollow cylindrical members operates as follows: When the piston rods 60, 64 are extended, the rearmost cylinder sleeves or hollow cylindrical members are pushed thereby, so that all the cylinder sleeves or hollow cylindrical members on the holder shafts are moved toward the distal ends thereof. The foremost cylinder sleeves or hollow cylindrical members are then released from the holder shafts. The next sleeves or hollow cylindrical members, which follow the released cylinder sleeves or hollow cylindrical members, are now positioned as new foremost cylinder sleeves or hollow cylindrical members on the holder shafts.

The piston rods 60, 64 are further extended to push the rearmost cylinder sleeves or hollow cylindrical members. All cylinder sleeves or hollow cylindrical members on the holder shafts are moved toward the distal ends thereof until the new foremost cylinder sleeves or hollow cylindrical members are released from the holder shafts.

The above operation is repeated until the rearmost cylinder sleeves or hollow cylindrical members come to the foremost position on the holder shafts. The piston rods 60, 64 are extended to push the rearmost cylinder sleeves or hollow cylindrical members until they are released from the holder shafts. In this manner, all the cylinder sleeves or hollow cylindrical members are pushed off the holder shafts.

Although a certain preferred embodiment of the present invention has been shown and described in detail, it should be understood that various changes and modifications may be made therein without departing from the scope of the appended claims.

What is claimed is:

1. An apparatus for holding a plurality of hollow cylindrical members and pushing off the hollow cylindrical members, comprising:

a holder shaft holding the hollow cylindrical members in tandem thereon;

a gripper member projecting outwardly from a side wall surface of the holder shaft and engaging an inner wall surface of a foremost one of the hollow cylindrical members held on the holder shaft;

a cam disposed in the holder shaft for displacing the gripper member;

pushing means for pressing an end face of a rearmost one of the hollow cylindrical members held by the holder shaft and moving all the hollow cylindrical members forward, to release the foremost one of the hollow cylindrical members from the holder shaft and to position a next one of the hollow cylindrical members as a new foremost one of the hollow cylindrical members on the holder shaft; and turning means for turning the holder shaft about an axis perpendicular to an axis of the holder shaft.

2. An apparatus according to claim 1, wherein the holder shaft holds two hollow cylindrical members in tandem thereon.

3. An apparatus according to claim 1, further comprising a plurality of the holder shafts.

4. An apparatus according to claim 1, wherein each of the hollow cylindrical members comprises a cylinder sleeve to be enclosed in a cylinder block by insert casting.

* * * * *